US008151594B2

(12) United States Patent
Kim

(10) Patent No.: US 8,151,594 B2
(45) Date of Patent: Apr. 10, 2012

(54) REFRIGERATOR, ICE BANK AND JOINT OF THE ICE BANK

(75) Inventor: Seong-Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 586 days.

(21) Appl. No.: 12/442,081

(22) PCT Filed: Sep. 19, 2007

(86) PCT No.: PCT/KR2007/004541

§ 371 (c)(1),
(2), (4) Date: Apr. 10, 2009

(87) PCT Pub. No.: WO2008/035913

PCT Pub. Date: Mar. 27, 2008

(65) Prior Publication Data

US 2009/0241582 A1 Oct. 1, 2009

(30) Foreign Application Priority Data

Sep. 20, 2006 (KR) ..... 10-2006-0091335

(51) Int. Cl.

| | |
|---|---|
| ***F25C 5/10*** | (2006.01) |
| ***F25C 5/02*** | (2006.01) |
| ***F16C 3/00*** | (2006.01) |

(52) U.S. Cl. ..... 62/344; 62/320; 464/182

(58) Field of Classification Search ..... 62/344, 62/320; 241/DIG. 17; 464/182
See application file for complete search history.

(56) References Cited

U.S. PATENT DOCUMENTS

| | | | |
|---|---|---|---|
| 4,176,527 | A | 12/1979 | Linstromberg et al. |
| 5,273,219 | A | 12/1993 | Beach, Jr. et al. |
| 6,442,954 | B1 | 9/2002 | Shapiro et al. |
| 2005/0132739 | A1 | 6/2005 | Sannasi et al. |

FOREIGN PATENT DOCUMENTS

| | | | |
|---|---|---|---|
| EP | 0937954 | B1 | 2/2001 |
| EP | 1 510 766 | A1 | 3/2005 |
| KR | 20-0163788 | Y1 | 2/2000 |
| KR | 10-2005-0076926 | A | 7/2005 |
| KR | 10-2006-0004548 | A | 1/2006 |

*Primary Examiner* — Chen Wen Jiang
(74) *Attorney, Agent, or Firm* — Birch, Stewart, Kolasch & Birch, LLP

(57) ABSTRACT

Provided is an ice bank joint. The ice bank joint swiftly delivers rotational force from a motor to a transferring shaft installed inside an ice bank performing a function of transferring ice received inside the ice bank. The ice bank joint includes a plate portion and a reinforcing member. The plate portion has a driving part bent on at least one position, and the reinforcing member has a support part protruding from a position corresponding to the driving part to contact the driving part, thereby reinforcing the plate portion.

27 Claims, 2 Drawing Sheets

[Fig. 1]
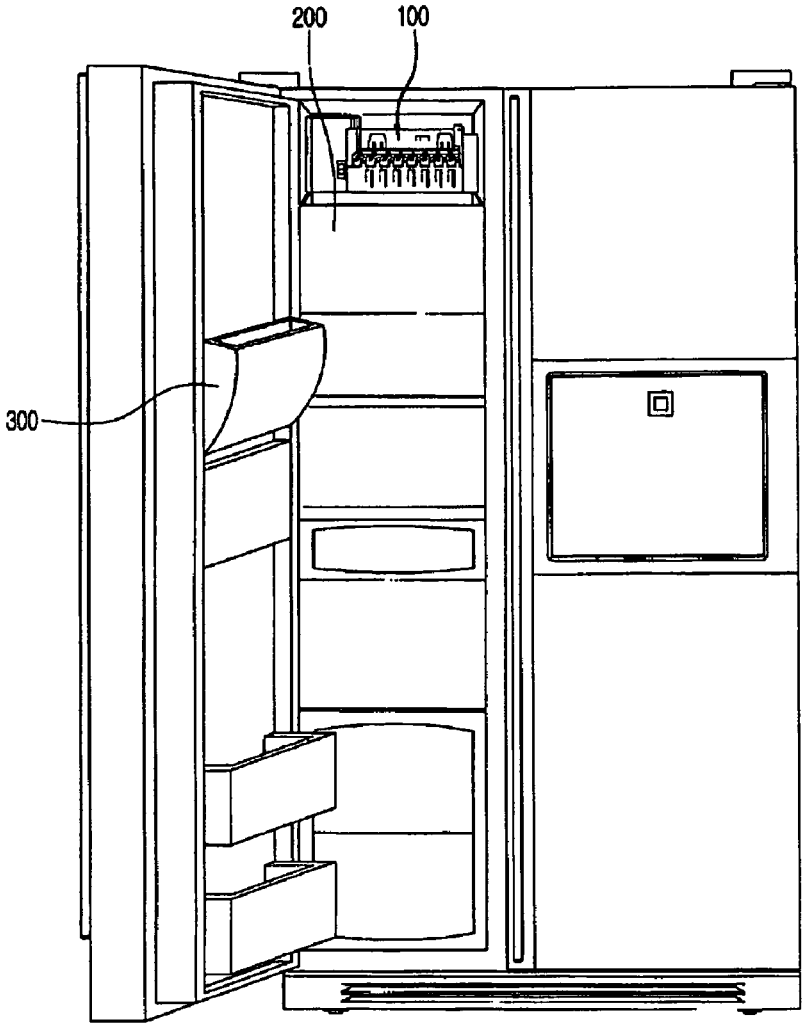
[Fig. 2]
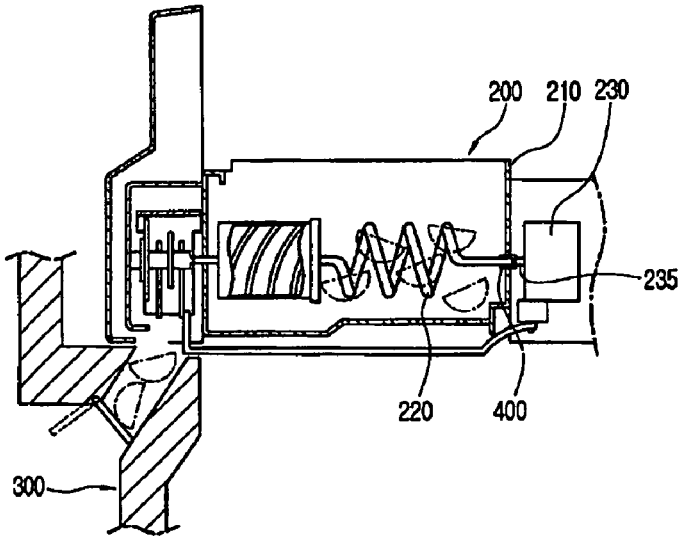

[Fig. 3]
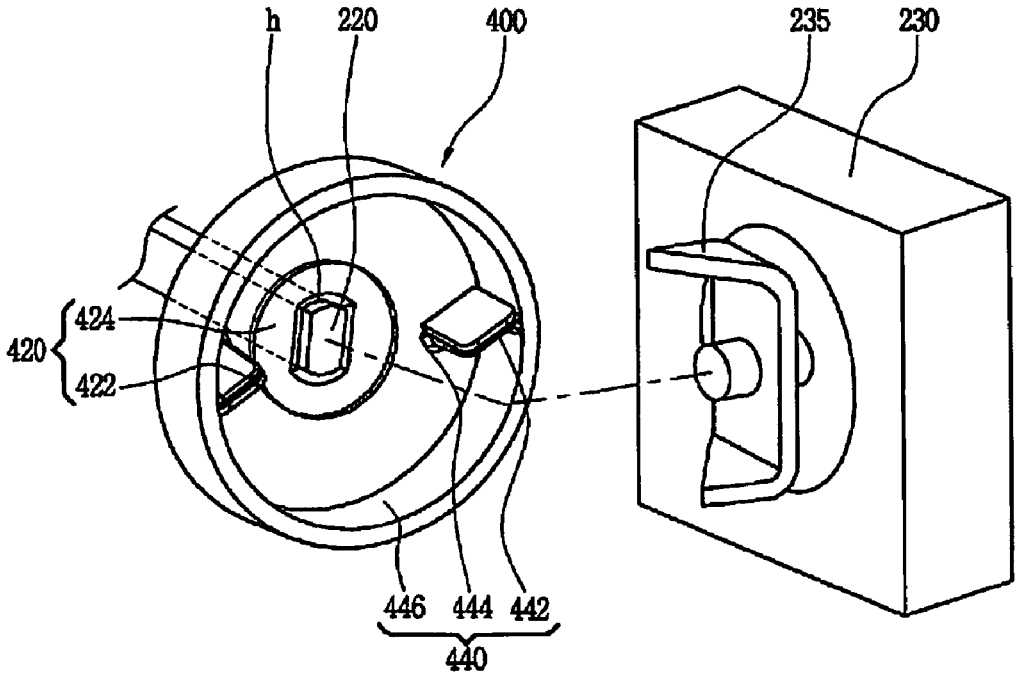
[Fig. 4]
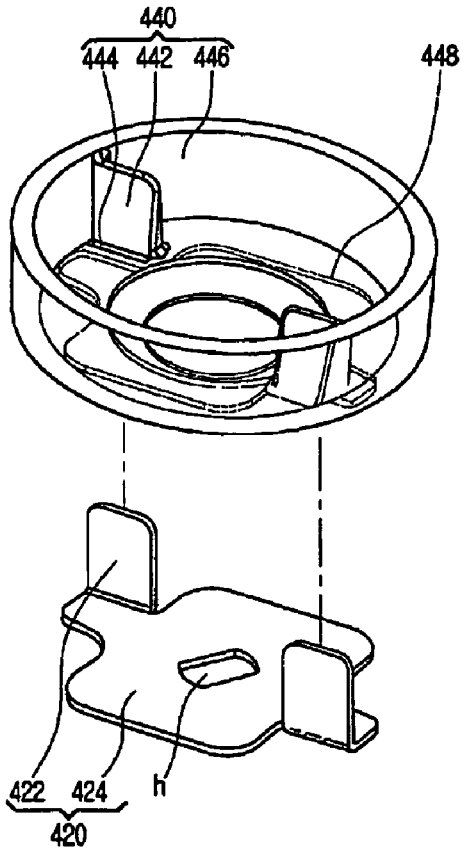

REFRIGERATOR, ICE BANK AND JOINT OF THE ICE BANK

TECHNICAL FIELD

The present disclosure relates to a refrigerator, and, to an ice bank for storing and Transferring ice, and a joint for use in a driving unit of the ice bank.

BACKGROUND ART

An ice maker is an apparatus for making ice in an appropriate size and discharging the ice by a required amount when a user needs the ice. An ice bank is a unit of elements forming the ice maker, for receiving made ice, and discharging an appropriated amount of the received ice. Also, depending on cases, only a portion for directly freezing water to make ice may be called an ice maker, a portion for storing the made ice may be called an ice bank, and a portion for discharging an appropriate amount of the stored ice to the outside may be called a dispenser.

There are various ice makers. Among them, an ice maker annexed to a refrigerator is disclosed in Korea Patent Publication No. 2005-0056484. This document discloses an entire system of the ice maker applied to the refrigerator. This type of ice maker is annexed to a refrigerator to satisfy a reasonable demand at low price, so that convenience in utilizing the ice maker increases.

A related art driving unit of an ice bank is described in more detail. The related art driving unit of the ice bank includes a motor and a motor shaft for providing driving force, and a rotation shaft for transferring ice in the inside of the ice bank. Also, the driving unit includes a joint as a portion for connecting the motor shaft and the rotation shaft with each other. The joint serves as a portion allowing driving force of the motor to be swiftly delivered to the rotation shaft.

The joint includes a body and a driving unit protruding to an inside from the body and at which the motor shaft is hooked. The body and the driving unit are integrally formed. Here, the body and the driving unit are connected to the motor shaft and is formed by sintered monolith stainless steel to secure sufficient strength against rotational force provided by the motor. This has been indispensably required to allow the joint to endure such sufficient strength as to crack clustered ice depending on the clustering state of the ice that has been broken into pieces in the inside of the ice bank.

Also, the body and the outer surface of the driving unit are plated with Ni—P to prevent the body and the driving unit from being corroded by water.

However, the above-described joint is formed by sintered monolith stainless steel and thus is heavy. Also, since the outer surface of the joint should be plated with Ni—P, processibility reduces and corrosion occurs when the plating is exfoliated.

DISCLOSURE OF INVENTION

Technical Problem

Embodiments provide an ice bank joint, an ice bank, and a refrigerator that can be manufactured in lightweight while maintaining strength. Embodiments also provide an ice bank joint, an ice bank, and a refrigerator that can be simply assembled to improve processibility and productivity. Embodiments also provide an ice bank joint, an ice bank, and a refrigerator that can improve corrosion caused by exfoliation of plating. Embodiments also provide an ice bank joint, an ice bank, and a refrigerator that can reduce a unit price of a product. Embodiments also provide an ice bank joint, an ice bank, and a refrigerator that can improve processibility of parts using the ice bank joint, improve heavy weight and corrosion, and reduce a unit price of a product.

Technical Solution

In one embodiment, a refrigerator includes: a storage room forming a low temperature space; a door for selectively opening the storage room; an ice maker for making ice in an inside of the storage room; an ice bank for storing ice made by the ice maker, and performing an operation of moving the ice; and a dispenser provided to the door to guide extraction of the ice inside the ice bank to an outside, wherein the ice bank includes: a bank for storing the made ice; a motor for generating rotational force; a transferring shaft installed inside the bank to transferring ice to the dispenser using the rotational force; and a joint on a connection part of the transferring shaft and the motor, and the joint includes: a plate portion connected to the transferring shaft to deliver force; and an reinforcing member having at least a portion contacting the plate portion to support the plate portion, and having lower strength than that of the plate portion.

In another embodiment, an ice bank includes: a bank for storing ice; a transferring shaft mounted inside the bank to transfer the ice; a motor mounted on one side of the bank to generate rotational force; and a joint on a connection part of the motor and the transferring shaft, wherein the joint includes: a plate portion contacting the motor to receive rotational force; and a reinforcing member for supporting the plate portion to reinforce strength of the plate portion.

In further another embodiment, an ice bank joint for swiftly delivering rotational force from a motor to a transferring shaft installed inside an ice bank in the ice bank performing a function of transferring ice received inside the ice bank, the ice bank joint includes: a plate portion manufactured in a plate; and a reinforcing member for supporting the plate portion to reinforce strength of the plate portion.

In still further another embodiment, an ice bank joint for swiftly delivering rotational force from a motor to a transferring shaft installed inside an ice bank in the ice bank performing a function of transferring ice received inside the ice bank, the ice bank joint includes: a plate portion having a driving part bent on at least one position; and a reinforcing member having a support part protruding from a position corresponding to the driving part to contact the driving part, thereby reinforcing the plate portion.

In still yet another embodiment, an ice bank joint for swiftly delivering rotational force from a motor to a transferring shaft installed inside an ice bank in the ice bank performing a function of transferring ice received inside the ice bank, the ice bank joint includes: a plate portion as a plate member, connected to the motor and the transferring shaft to deliver rotational force; and a reinforcing member having at least a portion contacting the plate portion to reinforce the plate portion, the plate portion and the reinforcing member plane-contacting each other.

Advantageous Effects

According to the present disclosure, a refrigerator can be manufactured in lightweight while maintaining strength, and a joint can be used through simple assembly, so that processibility can improve. Also, since a metal surface reduces, corrosion caused by exfoliation of plating can improve, and a unit price of a product can be reduced in comparison with using sintered metal.

BRIEF DESCRIPTION OF THE DRAWINGS

FIG. 1 is a view illustrating an example of a refrigerator according to an embodiment.

FIG. 2 is a view illustrating an example of an ice bank according to an embodiment.

FIG. 3 is a view illustrating a connection relation of a joint provided to an ice bank according to an embodiment.

FIG. 4 is a view illustrating an example of a joint provided to an ice bank according to an embodiment.

BEST MODE FOR CARRYING OUT THE INVENTION

Reference will now be made in detail to the embodiments of the present disclosure, examples of which are illustrated in the accompanying drawings.

FIG. 1 is a view illustrating an example of a refrigerator according to an embodiment.

Referring to FIG. 1, the refrigerator includes a freezing chamber forming a low temperature space and a door for selectively opening the freezing chamber. Also, the refrigerator includes an ice maker 100, an ice bank 200, and a dispenser 300, as an equipment for making ice. In an embodiment, the ice maker 200 is installed on one side of the storage room of the refrigerator to make ice. The ice bank 200 is installed below the ice maker 100 to store a large amount of ice frozen and separated from the ice maker 100. The stored ice is extracted to the outside through the dispenser 300 in the door. The dispenser 300 is connected to the ice bank 200 to allow ice transferred and extracted by the ice bank 200 to be extracted to the outside of the refrigerator through the dispenser 300.

FIG. 2 is a view illustrating an example of an ice bank according to an embodiment.

Referring to FIG. 2, the ice bank 200 includes a bank 210, a transferring shaft 220, a motor shaft 235, a motor 230, and a joint 400.

The bank 210 stores ice. In an embodiment, the bank 210 stores ice moved from the ice maker 100 illustrated in FIG. 1.

The transferring shaft 220 is provided inside the bank 210 to transfer ice stored in the bank 210. In an embodiment, the transferring shaft 220 is formed in a spiral shape to transfer the ice stored in the bank 210 along a shaft direction of the transferring shaft 220 using rotation of its own, and allow the ice to be extracted to the dispenser 300.

The joint 400 is an element for connecting the motor shaft 235 with the transferring shaft 220 to swiftly deliver rotational force between the motor shaft 235 and the transferring shaft 220. Force delivered through the joint 400 changes depending on the size and clustering degree of ice inside the bank 210. Particularly, it is required that rotational force is reliably delivered when the transferring shaft 220 overcomes static friction force so as to continue to rotate at an initial stage upon starting of rotation.

FIG. 3 is a view illustrating an example of a transferring shaft, a joint, a motor shaft, and a motor provided to an ice bank according to an embodiment.

Referring to FIG. 3, rotational force through the motor shaft 235 is delivered to the transferring shaft 220. At this point, the joint 400 is a portion where the motor shaft 235 and the transferring shaft 220 are connected to each other for swift delivery of rotational force. In an embodiment, the motor 230 and the motor shaft 235 are rotatably connected to the transferring shaft 220 provided inside the bank 210 through the joint 400. Here, the motor 230 is installed on one side of the bank 210 to provide rotational force, and the motor shaft 235 extends from the motor 230 to deliver rotational force provided by the motor 230 to the transferring shaft 220 through the joint 400.

In an embodiment, the motor shaft 235 is connected to the joint 400, and at least a portion of the motor shaft 235 is formed in a hook shape to deliver rotational force to the transferring shaft 220. In other words, at least a point of the motor shaft 235 extends further to the outer side from the center and then is bent and extends toward the transferring shaft 220. Also, at least a portion of the extended portion is hooked at the joint 400 to allow power to be swiftly delivered.

The joint 400 is located between the transferring shaft 220 and the motor shaft 235 to connect the transferring shaft 220 and the motor shaft 235, thereby delivering rotational force. In an embodiment, the joint 400 includes a plate portion 420 and a reinforcing member 440. The plate portion 420 delivers rotational force provided by the motor shaft 235 and the motor 230 to the transferring shaft 220, and is mounted to the reinforcing member 440 to receive support force.

In detail, the plate portion 420 includes a driving part 422 receiving rotational force from the motor shaft 235, and a connection part 424 including a shaft hole h into which the transferring shaft 220 is fit to deliver rotational force to the transferring shaft 220. Also, the reinforcing member 440 includes a rim-shaped body 446, a support portion 442 formed to contact the driving part 422 to provide support force to the driving part 422, a hole 444 located at the support portion 442 and into which the driving part 422 is fit, and a groove (refer to 448 of FIG. 4) in which the connection part 424 is seated. In an embodiment, the motor shaft 235 is located at the reinforcing member 440 and rotates with the driving part 422 of the plate portion 420 to deliver rotational force to the transferring shaft 220.

Next, an example of the joint 400 for the ice bank 200 will be described in detail according to an embodiment.

FIG. 4 is an exploded perspective view according to the present disclosure.

Referring to FIG. 4, a plate portion 420 includes a connection part 424 having an about quadrangular plate shape, and driving parts 422 extending at both sides of the connection part 424 facing each other to cross the connection part 424. At this point, the plate portion 420 is connected with a motor shaft 235 to receive rotational force, and delivers the rotational force to a transferring shaft 220. The plate portion 420 is formed of plate-shaped stainless steel to provide so sufficient strength as to prevent destruction and reduce manufacturing costs while swiftly delivering power. Also, in an embodiment, the driving parts 422 are formed by bending both sides extending from the connection part 424. To secure such processibility, the driving parts 422 may have a predetermined thickness (for example, 1.5 mm) or less.

In an embodiment, a reinforcing member 440 includes a body 446 formed in a circular shape on the whole. The reinforcing member 440 is formed in a rim shape having a cross-section of an 'L' shape. Also, the reinforcing member 440 includes a straight line shaped hole 444 into which the driving part 422 of the plate portion 420 is fit, so that the driving part 422 is fit into the hole 444. Also, a support portion 442 for supporting the driving part 422 at a position where the driving part 422 is fit, forms a wall in the inside of the reinforcing member 440. Accordingly, warping or deformation of the driving part 422 due to force (for example, 260 kgf) given to the plate portion 420 by the motor shaft 235 while the plate portion 420 rotates, can be prevented. Also, in an embodiment, the reinforcing member 440 includes a groove 448 into which the connection part 424 of the plate portion 420 is fit. This is for improving coupling force between the plate portion 420 connected to the motor shaft 235 and the transferring shaft 220, and the reinforcing member 440, when the plate portion 420 is fit to and seated on the rear side of the reinforcing member 440.

In an embodiment, the reinforcing member 440 is formed of plastic having lower strength than that of the plate portion to reduce manufacturing costs, reduce the entire weight of the joint 400, and prevent corrosion. However, since the reinforcing member 440 can be provided in a relatively large size in an aspect of material characteristic, strength of the reinforcing member 440 can be easily reinforced.

Since the joint 400 includes the plate portion 420 and the reinforcing member 440, a fact that strength of the joint 400 is weak when only the reinforcing member 440 is used, and a fact that deformation of warping of the plate portion 420 may occur can be complemented respectively, so that sufficient strength can be provided against strong rotational force of the motor 230. In other words, the motor shaft 235 delivers force to the reinforcing member 440 through the driving parts 422 without directly contacting the reinforcing member 440. Therefore, the entire surface of the driving parts 422 contacts the reinforcing member 440, and consequently, uniform force is applied to the reinforcing member 440, particularly, to the entire surface of the support parts 442, so that force can be stably delivered.

MODE FOR THE INVENTION

Though a preferred embodiment has been proposed according to a best embodiment, the present disclosure further includes following another embodiment.

First, though the driving part 422 and the support portion 442 correspond to each other according to the preferred embodiment, they are not limited thereto, but the sprit of the present disclosure is maintained even when the shape changes. For example, even when the driving part 422 is formed a little small for reduction of material costs, a purpose of complementing the deformation of the plate portion and the strength of the reinforcing member can be sufficiently achieved as long as the motor shaft 235 contacts the driving parts 422.

Second, though a preferred embodiment proposes that the two driving parts 422 and the support portions 442 are provided to locations, respectively, corresponding to each other, the present disclosure is not limited thereto, but one, three, or more driving parts 422 and support portions 442 can be provided with equal intervals. It is noted that when the two driving parts 422 and the support portions 442 are provided with equal intervals, a swift rotational motion can be performed through equilibrium of couple forces. Further, in the case where the size of the joint is small, the number of joints can be increased to stably deliver rotational force.

Third, though a preferred embodiment proposes that the driving part and the support portion are quadrangular, the present disclosure is not limited thereto, but they can be provided in a circular shape or a different similar shape as long as force can be reliably delivered.

Fourth, though a preferred embodiment proposes that the motor shaft contacts the plate portion, the present disclosure is not limited thereto, but the motor shaft may contact the reinforcing member to deliver force in the case where plane contact relation between the motor shaft and the reinforcing member is clearly established. However, it is more preferable that the motor shaft contacts the plate portion, for reliably force delivery, convenience in manufacturing, and friction prevention.

Fifth, though a preferred embodiment proposes that the shaft hole is formed in the plate portion, the shaft hole can be formed in the reinforcing member as long as reasonable strength can be secured to the reinforcing member. However, power can be more swiftly delivered by forming the shaft hole in the plate portion made of metal, of course. Depending on cases, the same shaft holes can be formed in both the plate portion and the reinforcing member, respectively, to achieve more reliable operation.

Sixth, though a preferred embodiment proposes that the plate portion is fit in the reinforcing member, the present disclosure is not limited thereto, but the plate portion and the reinforcing member can be connected to each other using inmold or insert molding. In this case, a separate molding process for the reinforcing member is not required, so that a process is shortened.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible by addition, modification, and deletion of component parts within the scope of the disclosure, the drawings and the appended claims.

Industrial Applicability

The present disclosure can be manufactured in lightweight while maintaining reasonable strength, and allow a joint to be used through a simple assembly process to improve processibility. Also, according to the present disclosure, a metal surface reduces, so that corrosion due to exfoliation of plating can be prevented, and manufacturing costs can be reduced in comparison with using sintered metal.

The invention claimed is:

1. A refrigerator comprising:

a storage room forming a low temperature space;

a door for selectively opening the storage room;

an ice maker for making ice in an inside of the storage room;

an ice bank for storing ice made by the ice maker, and performing an operation of moving the ice; and a dispenser provided to the door to guide extraction of the ice inside the ice bank to an outside, wherein the ice bank comprises:

a bank for storing the made ice;

a motor for generating rotational force;

a transferring shaft installed inside the bank to transfer ice to the dispenser using the rotational force; and a joint on a connection part of the transferring shaft and the motor, and the joint comprises:

a plate portion connected to the transferring shaft to deliver force; and an reinforcing member having at least a portion contacting the plate portion to support the plate portion, and having lower strength than that of the plate portion.

2. The refrigerator according to claim 1, wherein the plate portion is manufactured by processing a thin plate.

3. The refrigerator according to claim 1, wherein the plate portion comprises:

a connection part on which the reinforcing member is disposed; and a driving part bent from the connection part and plane-contacting with a portion of the reinforcing member.

4. The refrigerator according to claim 3, wherein the driving part is inserted into the reinforcing member.

5. The refrigerator according to claim 1, wherein the plate portion is formed of metal, and the reinforcing member is formed of plastic.

6. The refrigerator according to claim 1, wherein the plate portion directly receives rotational force from a motor shaft.

7. The refrigerator according to claim 1, wherein at least a portion of the plate portion is seated in and supported by a groove formed in the reinforcing member.

8. The refrigerator according to claim 1, wherein the plate portion is connected with the reinforcing member through one of inmold or insert molding.

9. An ice bank comprising:

a bank for storing ice;

a transferring shaft mounted inside the bank to transfer the ice;

a motor mounted on one side of the bank to generate rotational force; and a joint on a connection part of the motor and the transferring shaft, wherein the joint comprises:

a plate portion contacting the motor to receive rotational force; and a reinforcing member for supporting the plate portion to reinforce strength of the plate portion.

10. The ice bank according to claim 9, wherein the plate portion is fit into the reinforcing member.

11. The ice bank according to claim 9, wherein the plate portion is formed of metal, and the reinforcing member is formed of plastic.

12. The ice bank according to claim 9, wherein the plate portion is manufactured by processing a thin plate.

13. The ice bank according to claim 9, wherein the reinforcing member has an about rim shape, and comprises a support part protruding to an inside of the rim shape, and a hole into which the plate portion is inserted and the hole is formed in a position adjacent to the support part.

14. The ice bank according to claim 13, wherein the hole is formed in a straight line shape.

15. The ice bank according to claim 9, wherein a portion of a motor shaft coupled to the motor, extends to an outside only partially to contact the plate portion, delivering rotational force to the plate portion.

16. An ice bank joint for swiftly delivering rotational force from a motor to a transferring shaft installed inside an ice bank in the ice bank performing a function of transferring ice received inside the ice bank, the ice bank joint comprising:

a plate portion manufactured in a plate; and a reinforcing member for supporting the plate portion to reinforce strength of the plate portion.

17. The ice bank joint according to claim 16, wherein a shaft hole is formed in at least one of the plate portion and the reinforcing member, so that the transferring shaft is connected to the shaft hole.

18. The ice bank joint according to claim 16, wherein the plate portion is connected to the motor and the transferring shaft.

19. The ice bank joint according to claim 16, wherein the plate portion is formed of stainless, and the reinforcing member is formed of plastic.

20. The ice bank joint according to claim 16, further comprising:

a support part protruding from the reinforcing member; and a driving part formed at the plate portion to contact the support part.

21. The ice bank joint according to claim 20, wherein the driving part passes through and is supported by the reinforcing member.

22. The ice bank joint according to claim 16, wherein the plate portion has a thickness of 1.5 mm or less.

23. An ice bank joint for swiftly delivering rotational force from a motor to a transferring shaft installed inside an ice bank in the ice bank performing a function of transferring ice received inside the ice bank, the ice bank joint comprising:

a plate portion having a driving part bent on at least one position; and a reinforcing member having a support part protruding from a position corresponding to the driving part to contact the driving part, thereby reinforcing the plate portion.

24. The ice bank joint according to claim 23, wherein the driving part contacts a motor shaft through which rotational force of the motor is delivered to receive the rotational force, and the transferring shaft is connected to a center of the plate portion.

25. The ice bank joint according to claim 23, wherein the reinforcing member has an about rim shape, and the support part is formed on an inner surface of the reinforcing member.

26. An ice bank joint for swiftly delivering rotational force from a motor to a transferring shaft installed inside an ice bank in the ice bank performing a function of transferring ice received inside the ice bank, the ice bank joint comprising:

a plate portion as a plate member, connected to the motor and the transferring shaft to deliver rotational force; and a reinforcing member having at least a portion contacting the plate portion to reinforce the plate portion, the plate portion and the reinforcing member plane-contacting each other.

27. The ice bank joint according to claim 26, wherein a portion where the plate portion and the reinforcing member plane-contact each other is a portion where the plate portion receives rotational force of the motor.

* * * * *